United States Patent [19]

Farrell

[11] Patent Number: 4,620,653

[45] Date of Patent: Nov. 4, 1986

[54] ADJUSTABLE BELT STEREO PLAYER HOLDER

[76] Inventor: Edwin B. Farrell, 316 Pioneer Club Rd., East Grand Rapids, Mich. 49506

[21] Appl. No.: 693,542

[22] Filed: Jan. 22, 1985

[51] Int. Cl.[4] ..... B65D 25/10

[52] U.S. Cl. ..... 224/242; 224/219; 224/246

[58] Field of Search ..... 224/219, 222, 224, 231, 224/242, 901, 904, 243, 245, 250, 246, 247, 249, 251, 225, 228, 902, 148; 2/311, 312

[56] References Cited

U.S. PATENT DOCUMENTS

| | | | |
|---|---|---|---|
| 1,530,342 | 3/1925 | Barber | 224/224 |
| 2,625,192 | 1/1953 | Kinskie | 224/902 X |
| 2,914,070 | 11/1959 | Kellner et al. | 2/311 X |
| 3,813,017 | 5/1974 | Pimsleur | 224/901 X |
| 3,891,174 | 6/1975 | Harvey | 224/250 X |
| 3,977,582 | 8/1976 | McMahon | 224/246 |
| 4,135,653 | 1/1979 | Sieloff | 224/222 |
| 4,234,116 | 11/1980 | Myers | 224/250 |
| 4,326,300 | 4/1982 | Bolton et al. | 2/311 X |
| 4,432,477 | 2/1984 | Haidt et al. | 224/901 X |
| 4,449,654 | 5/1984 | Cappis | 224/148 |
| 4,523,702 | 1/1985 | Viio | 224/904 X |

*Primary Examiner*—Stephen Marcus
*Assistant Examiner*—Robert Petrik
*Attorney, Agent, or Firm*—James M. Deimen

[57] ABSTRACT

The holder comprises an adjustable belt sized to be securely but comfortably affixed about the waist of a person engaging in vigorous athletic activity. Affixed to the belt is a pocket having an inner pocket or sleeve adjustable to tightly retain a stereo player therein and thereby prevent the player from inadvertently falling or bouncing out of the pocket. The sleeve is adjustably fastened with a tongue that extends through an aperture in the back of the pocket and belt. The aperture is positioned in the pocket back to best prevent movement of the stereo player relative to the pocket and the belt by pulling the player to the back of the pocket rather than completely enfolding the player in the sleeve. Thus, the object of preventing movement of the player relative to the wearer is better attained. Hook and loop fasteners join the tongue to the back of the belt. The belt includes a plurality of hook and loop fasteners spaced along a portion of the belt extending to one side of the pocket. The fasteners enable the wearer to shorten the belt as desired and to fasten back the loose end of the belt. By providing the multiple set of fasteners a single belt size can be manufactured and sold for the entire realistic range of belt sizes for both men and women, nevertheless also eliminating the loose end of the belt and any movement of portions of the belt relative to the wearer.

21 Claims, 11 Drawing Figures

FIG. 1
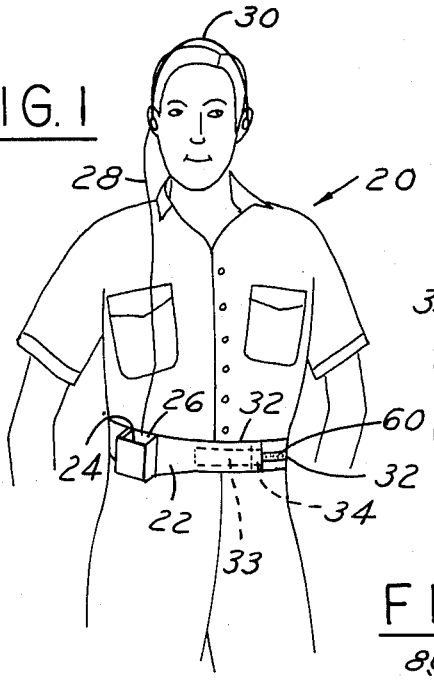
FIG. 4
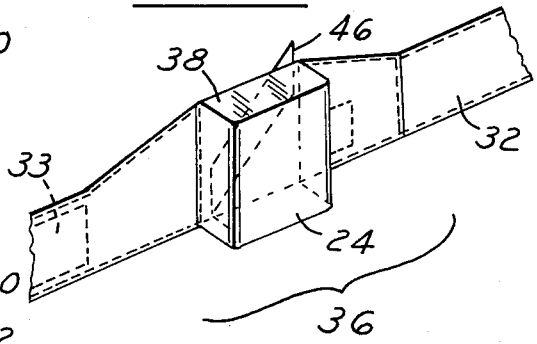
FIG. 2
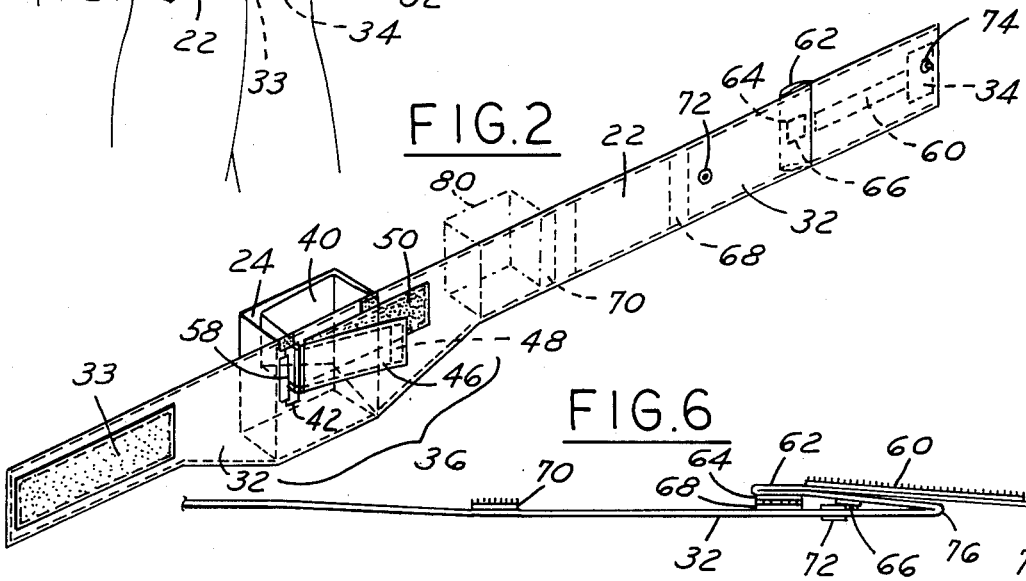
FIG. 6
FIG. 3
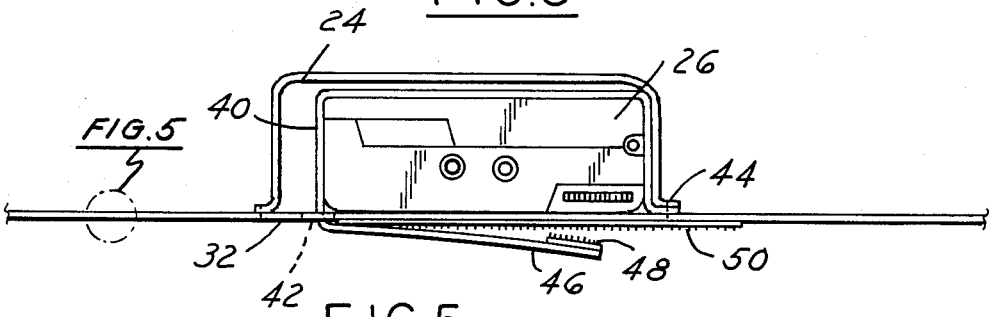
FIG. 5
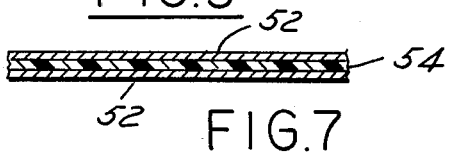
FIG. 7
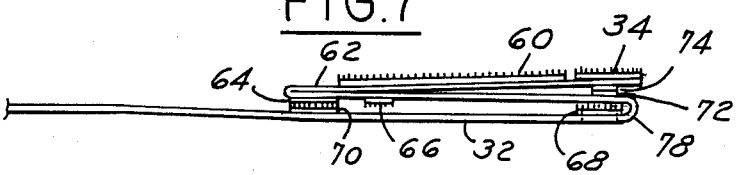

FIG.8
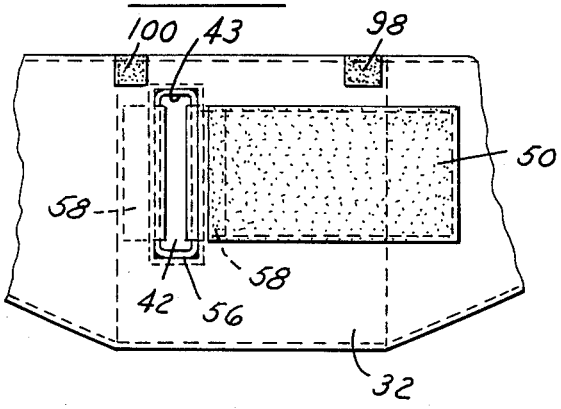
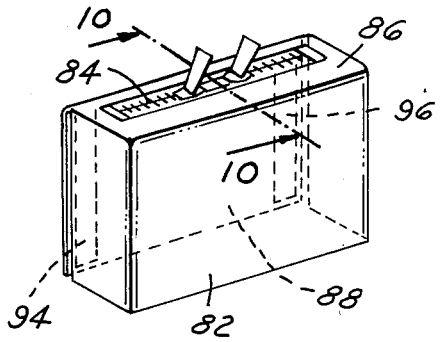
FIG.9
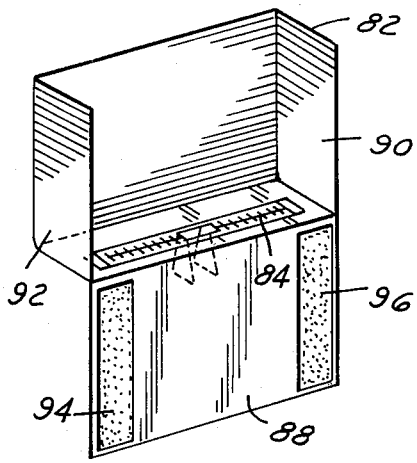
FIG.11
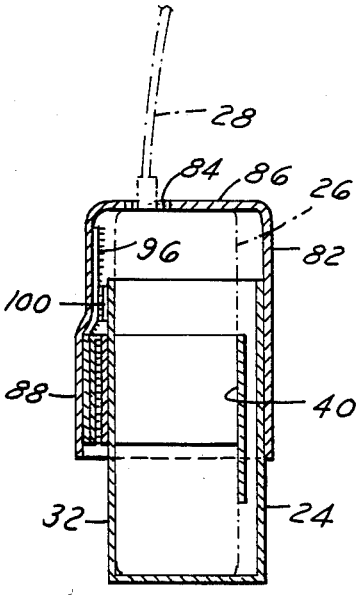
FIG.10

ADJUSTABLE BELT STEREO PLAYER HOLDER

BACKGROUND OF THE INVENTION

The field of the invention pertains to devices to retain "personal" portable radios and tape recorders to a person engaged in vigorous athletic activity. In particular, the field of the invention pertains to convenient flexible devices to comfortably attach a stereo tape player to a person in a manner that protects the player against damage and the person against abrasion of his or her skin or more serious injury. Typically, many of the players include clips, loops or shoulder straps sold with the players.

Early U.S. Pat. No. 641,987 discloses a letter carrier's bag having a vertically adjustable panel and tongue to retain letters neatly stacked. U.S. Pat. No. Des. 238,725 and U.S. Pat. No. 4,029,243 both disclose a belt and relatively large zippered pocket thereon. The pocket generally extends about one third to one half the belt length or about the back of the wearer from one side to the other. U.S. Pat. No. 4,073,416 discloses a means for strapping a Citizens Band radio to a panel in turn mounted on a belt. The belt includes a protective poncho for the radio and a small pocket for microphone and battery.

Recently several devices have been marketed that retain or carry a player on the person without the need for holding the player in the hand. The "PRO-KAP" available from Audiowrap, Inc., Lincoln, Nebr. is a strap that fastens the player to the person's upper arm. The "PRO-KAP" becomes increasingly uncomfortable with each flexing of the bicep muscle. Because of the flexing, the "PRO-KAP" can slip down the arm and a player lacking a belt clip can slide from the device and fall. Other holders utilize a purse like device with a shoulder strap that can be attached about the neck or neck and one shoulder in addition to merely one shoulder. The "JOG PAK", available from Jog Pak, Washington, D.C. also includes straps to fasten about the chest or to convert to a conventional belt. In all of its modes, however, the JOG PAK is free to move relative to the wearer and therefore uncomfortable and unsecure during vigorous exercise. The relative movement is also a potential source of skin abrasion and excess strap ends tend to flop around and interfere with the activities of the wearer.

The "SOUND CARRIER" available from Sport Motivational Tapes, Ltd., Wichita, Kans. and the "TRAK PAK" available from Trak Pak, Cincinnati, Ohio both comprise a single pouch on a belt and positioned in the small of the back of the wearer. The size and construction of each limit their versatility. The "SOUND CARRIER" retaining strap covers a portion of the pocket opening to retain the player in the pocket. The flap cover on the "TRAK PAK" prevents operation of top mounted controls on the player.

In summary there exists a need for a player holder that secures the player to the person tightly but comfortably with suitable means to tightly retain the player and to tightly retain the strap or belt ends.

SUMMARY OF THE INVENTION

Applicant's holder comprises an adjustable belt sized to be securely but comfortably affixed about the waist of a person. Affixed to the belt is a pocket having an inner pocket or sleeve adjustable to tightly retain a player therein and thereby prevent the player from inadvertently falling or bouncing out of the pocket or otherwise moving relative to the wearer. The sleeve is adjustably fastened with a tongue that extends from the sleeve through an aperture in the back of the pocket and belt. The aperture is positioned in the pocket back to best prevent movement of the player relative to the pocket and the belt by pulling the player to the back pocket rather than completely enfolding the player in the sleeve. Thus, the object of preventing movement of the player relative to the wearer is better attained. On the back of the belt hook and loop fastening means join the tongue to the belt securely. Additional security is provided by the person's waist against the back of the belt.

The belt includes a plurality of means to shorten the overall length of the belt and to fasten back the loose end of the belt. The means to shorten and fasten back the belt permit the manufacture of a single belt length or belt size for all waist sizes thereby reducing manufacturing and inventory costs. In the preferred embodiment the shortening and fastening back means comprise a combination of additional hook and loop fastening means and snap fastener means positioned along the length of the belt to one side of the pocket. Thus, the belt size can be properly adjusted over the entire realistic range of belt sizes for both men and women, nevertheless also eliminating the loose end of the belt and any movement of the belt relative to the wearer.

DESCRIPTION OF THE DRAWINGS

FIG. 1 illustrates the adjustable belt stereo player holder as positioned on a person;

FIG. 2 is a perspective view of the holder in the right-side-up position;

FIG. 3 is a partial top view of the holder;

FIG. 4 is a partial perspective view of the holder in upside-down position;

FIG. 5 is a detail of the holder cloth construction;

FIG. 6 and FIG. 7 detail from above the means to shorten the belt;

FIG. 8 is a back view of the pocket portion of the holder;

FIG. 9 is a perspective view of a cover for the pocket;

FIG. 10 is a cross section of the cover taken along the line 10—10 in FIG. 9 but including the pocket thereunder; and, FIG. 11 is a perspective view of the cover of FIG. 9 in open position.

DESCRIPTION OF THE PREFERRED EMBODIMENTS

Illustrated in FIGS. 1 and 2 is a person generally denoted by 20 wearing the adjustable belt stereo player holder 22 about the waist. In a pocket 24 the holder 22 retains a stereo radio or tape player 26 having a cord 28 and ear phones 30 extending therefrom. The pocket 24 is sewn to a belt 32 that extends about the waist and has sewn thereto a loop fastener 33 at one end. At the other end is a hook fastener 34 sewn thereto. The loop 33 and hook 34 fasteners are complementary "hook and loop" woven fasteners such as "Velcro" brand hook and loop fasteners. The belt length is thereby adjustable over a range given by the length of the loop fastener 33 minus the length of the hook fastener 34.

Referring to FIGS. 2 and 4, the belt 32 includes a wide or extended portion 36 to fully back and support the pocket 24. The pocket 24 is generously sized to retain the largest stereo radio or tape player expected to be carried conveniently by a person, in particular, a jogger or runner. A suitable size is a depth of 4-½ inches, length of 4 inches and thickness of 1-178 inches, however the pocket 24 is not limited to this particular size. The pocket 24 includes a bottom panel 38 to support the stereo player, the bottom panel 38 being sewn to the pocket sides at the bottom edges.

In FIGS. 2 and 3 is shown an inner adjustable pocket or sleeve 40 positioned within the pocket 24. The sleeve 40 is sewn sturdily to the inside of the pocket 24 and the belt 32 as indicated at 44. A vertical slot 42 forms an aperture through the belt 32 which in turn also serves as the back wall of the pocket 24. The slot 42 is adjacent the opposite side of the pocket from the side where the sleeve is sewn at 44. The sleeve 40 forms a loop about the stereo player 26 within the pocket 24. The sleeve 40 has extending therefrom an integral tongue 46 of diminished height which in turn extends through the slot or aperture 42. The sleeve tongue 46 and the belt 32 have sewn thereto complementary hook and loop fasteners 48 and 50 respectively. As shown the loop fastener 50 faces the wearer's body as does the loop fastener 33. The loop fasteners are less abrasive against skin than the hook fasteners, therefore the belt is constructed to prevent the contact of any hook fasteners against the skin. The hook fastener 48 need only be a small patch at the tip of the tongue 46 as shown whereas the loop fastener 50 is extended for a distance along the belt 32 sufficient to accommodate the various sizes of stereo players that might be placed in the pocket 24 within the sleeve 40. Thus, after tightly fitting the sleeve 40 about the stereo player 26 as shown in FIG. 3, the hook fastener 48 can be tightly engaged with the loop fastener 50 to retain the stereo player 26 in the pocket 24 although the pocket 24 is much larger than the stereo player. In this manner any smaller size stereo player 26 can be retained in the pocket 24 without a strap or other means over the top opening of the pocket 24.

In FIG. 5 the construction of the belt 32 and pocket 24 material is illustrated. The belt and pocket are preferably constructed of a three-ply material comprising two exterior plies of taffeta nylon 52 and an interior ply of felt, non-woven interfacing, synthetic foam or other soft bulky material 54. The materials selected should be soft and reasonably non-abrasive because the belt 32 will often be worn against bare skin under jogging conditions. The materials should also be substantially unaffected by water and human sweat with permanent dyes and colorants that can tolerate frequent washing in strong detergent. Constructed with the triple layer including the soft bulky middle layer disclosed in FIG. 5, the sleeve 40 retains the stereo player 26 securely and the belt 32 is comfortable to the wearer. The taffeta nylon abrasion resistance provides relatively long usefulness for the holder. The triple layer, however permits any push buttons on the sides of a stereo player 26 to be operated from outside the pocket through the material.

When an exceptionally smooth or slippery material is used for the belt and pocket, the sleeve 40 may alternatively be lined with rubber or other non-slippery material to better grip the player 26. Under normal circumstances, however, the location of the slot 42 causes the player 26 to be held tightly against the belt 32 and the top edge 43 of the aperture 42 (see FIG. 8) prevents the sleeve 40 and player 26 from tending to move upwardly out of the pocket at the aperture end of the pocket.

To minimize stress about the aperture 42 a ring 56 of hard plastic or metal is affixed in the opening by a pair of flaps 58 wrapped about the ring on either side as best shown in FIG. 2 or FIG. 8. FIG. 2 and FIG. 8 illustrate alternative constructions for the ring 56 attachment. In FIG. 2 each flap 58 is sewn to the outside of the exterior plies 52. In FIG. 8 the flaps 58 are sewn between the exterior plies 52 and the interior ply 54. Without the ring 56 the belt material is subject to severe distortion about the aperture 42 and possible eventual tearing due to the tension of the belt 32. With the ring the tension in the belt is carried by the ring 56 about the aperture 42 rather than the material. Another alternative is an oblong grommet inserted in the aperture 42 and affixed to the belt material about the aperture.

FIGS. 2, 6, and 7 illustate the belt shortening and fasten back features. Extending lengthwise from the hook fastener 34 is a strip 60 of hook fastener. The strip 60 terminates adjacent a flap 62 that extends outwardly from the belt 32 and is sewn to or formed with the belt material. The flap 62 has attached thereto hook fastener 64 facing toward the pocket 24. Adjacent the flap 62 is a small strip of loop fastener 66 on the belt to retain the flap 62 to the belt by attachment to the hook fastener 64. Further along the belt 32 are two additional loop fasteners 68 and 70 sewn therto. On the back side of the belt are a pair of complementary snap fasteners 72 and 74.

The strip 60 retains the loose end of the belt tongue by attaching thereto the portion of the loop fastener 33 that extends beyond the hook fastener 34. In FIG. 6 the belt 32 is partially shortened by folding over the belt 32 as shown at 76 and attaching loop fastener 68 to hook fastener 64. To fully shorten the belt 32, the belt is folded as shown at 78 in FIG. 7 and hook fastener 64 is attached to loop fastener 70. In addition, in FIG. 7 the complementary snaps 72 and 74 are snapped to retain the folded portion of the belt together. Typically, the spacing between fastener 34 and flap 62, between flap 62 and fastener 68 and between fastener 68 and fastener 70 are substantially identical. Thus, the attachment illustrated in FIG. 6 shortens the belt by about one space between fasteners 64 and 68 and the attachment illustrated in FIG. 7 by about two spaces between fasteners 64 and 70. As an example, the three size ranges can be 32-½ inches to 38 inches in FIG. 2, 27 inches to 32-½ inches in FIG. 6 and 21-½ inches to 27 inches in FIG. 7. Preferably the length of loop fastener 33 is substantially equal to the distance between fasteners 68 and 70 plus the length of hook fastener 34 and strip fastener 60 beyond hook fastener 34 also substantially equal to the distance between fasteners 68 and 70. These lengths assure that the belt is continuously adjustable over the above full range of sizes and that the excess loop fastener 33 and end of belt can always be fastened down.

In summary the belt is sized for the largest waist to be expected and the spacing selected to accommodate the smallest waist expected. As illustrated in FIG. 2, the portion of the belt 32 encompassed by the spacing and fasteners 34, 64, 68 and 70 is approximately one-half the total belt length. The remainder of the belt, in addition to the pocket 24 and loop fastener 33, can provide a position for a second pocket 80 (shown ghosted) to retain a battery pack, small water bottle, keys or money. Although shown as a smaller and conventional pocket, the second pocket can also be similar in construction to the pocket 24.

Referring to FIGS. 8 through 11, as an optional feature a detachable cover 82 of water resistant or waterproof material may be included. The cover 82 includes a double tang zipper 84 sewn into the top 86. The back 88 of the cover 82 is not connected to the sides 90 and 92 of the cover as best shown in FIG. 11 where the cover is flipped open. Inside the back 88 of the cover are two hook strips 94 and 96 spaced apart to attach to two loop fasteners 98 and 100 on the back of the belt 32 as shown in FIG. 8. The hook strips 94 and 96 permit the cover to be adjusted vertically to accommodate players that extend above the top of the pocket 24 as best shown in FIG. 10. The double tang zipper 84 permits the earphone cord 28 and jack to be plugged through the cover into the player 26.

I claim:

1. In a belt adapted to be wrapped and fastened securely about the waist of a person with the back of the belt adjacent the person and a pocket affixed to the front of the belt and extending outwardly therefrom, the improvement comprising in combination, a sleeve in said pocket affixed at one end of the sleeve within the pocket and having a tongue portion at the opposite end of the sleeve, an oblong aperture in the back of the pocket extending through the belt, said aperture located adjacent the side of the pocket opposite the side where the sleeve is affixed, and adjustable complementary attachment means on said tongue and the back of the belt adjacent the aperture, said tongue extending through said aperture for engagement with the back of the belt.

2. The belt and pocket combination of claim 1 wherein the sleeve is affixed to the pocket at the attachment of the pocket side thereadjacent the sleeve and the belt.

3. The belt and pocket combination of claim 1 wherein the aperture is spaced from the pocket side furthest therefrom a distance of approximately three inches.

4. The belt and pocket combination of claim 1 including an oblong relatively rigid reinforcing ring defining the periphery of the aperture.

5. The belt and pocket combination of claim 1 including a second pair of complementary attachment means attached to the belt and spaced along the belt from one end thereof to provide for shortening the belt by folding over a portion of the belt and attaching the pair of complementary attachment means.

6. The belt and pocket combination of claim 5 wherein one of the second pair of attachment means extends outwardly from the belt.

7. The belt and pocket combination of claim 5 including a third attachment means complementary to one of the second pair of complementary attachment means and spaced therefrom to provide for an alternative different shortening of the belt.

8. The belt and pocket combination of claim 7 wherein the attachment means complementary to the third attachment means extends outwardly from the belt.

9. The belt and pocket combination of claim 8 including means to retain the outwardly extending attachment means against the belt.

10. The belt and pocket combination of claim 5 including fourth complementary attachment means spaced apart and affixed to the belt on the side opposite the second pair of complementary attachment means.

11. The belt and pocket combination of claim 7 including fourth complementary attachment means spaced apart and affixed to the belt on the side opposite the second pair of complementary attachment means.

12. A stereo player holder comprising a belt adapted to be wrapped and fastened securely about the waist of a person with the back of the belt adjacent the person, a pocket affixed to the front of the belt and extending outwardly therefrom, a plurality of attachment means affixed to the belt and spaced apart along the belt intermediate the ends of the belt, one of said attachment means being complementary to the other attachment means intermediate the ends of the belt and extending outwardly from said belt whereby the belt can be shortened by folding over a portion of the belt and attaching the complementary attachment means to one of the other attachment means intermediate the ends of the belt, and additional attachment means to join the ends of the belt together, said additional attachment means including adjustable means to retain the loose end of the belt to the other end of the belt, said loose end retention means being separate from the plurality of attachment means intermediate the ends of the belt for shortening the belt;

wherein the pocket contains a sleeve therein affixed at one end of the sleeve to the inside of the pocket adjacent one side of the pocket, said sleeve including a tongue portion extending from the other end thereof, and wherein the pocket includes an aperture extending through the back of the pocket and the belt, said tongue portion extending through said aperture and having adjustable means to attach to the back of said belt.

13. The stereo player holder of claim 12 including a separate second pair of complementary attachment means affixed to the opposite side of the belt and spaced apart whereby the end of the belt nearest the plurality of attachment means can be attached to the folded portion of the belt.

14. The stereo player holder of claim 12 including means to retain the outwardly extending complementary attachment means folded over against the belt, said retention means adjacent the outwardly extending complementary attachment means.

15. The stereo player holder of claim 12 including an oblong relatively rigid reinforcing ring defining the periphery of the aperture.

16. The stereo player holder of claim 12 wherein said aperture is located adjacent the pocket side opposite the pocket side adjacent the attachment of the sleeve to the pocket.

17. The stereo player holder of claim 16 including a cover for said pocket, said cover having a top, sides and back and including vertically adjustable attachment means inside the cover back, attachment means complementary to the cover attachment means on the back of the belt adjacent the pocket, said cover back flexibly attached to the cover top and unattached to the cover sides.

18. The stereo player holder of claim 17 wherein said cover top includes a double tang zipper.

19. In a belt adapted to be wrapped and fastened securely about the waist of a person and a pocket affixed to the front of the belt and extending outwardly therefrom, the improvement comprising in combination, an oblong aperture through the back of the belt and into the pocket, a sleeve in said pocket affixed at one end of the sleeve within the pocket and the opposite end of the sleeve extending through said aperture, and adjustable complementary attachment means on the end of said sleeve extending through and beyond said aperture and on the back of the belt adjacent the aperture for engagement therebetween.

20. The belt and pocket combination of claim 19 wherein the aperture is located adjacent one side of the pocket and spaced from the pocket side furthest therefrom a distance of approximately three inches.

21. The belt and pocket combination of claim 19 including a cover for said pocket, said cover having a top, sides and back and including vertically adjustable attachment means inside the cover back, attachment means complementary to the cover attachment means on the back of the belt adjacent the pocket, said cover back flexibly attached to the cover top and unattached to the cover sides.

* * * * *

UNITED STATES PATENT AND TRADEMARK OFFICE

CERTIFICATE OF CORRECTION

PATENT NO. : 4,620,653

DATED : November 4, 1986

INVENTOR(S) : Edwin B. Farrell

It is certified that error appears in the above-identified patent and that said Letters Patent are hereby corrected as shown below:

Column 2, line 7: Insert -- of the -- after "back".

Column 3, line 4: Delete "1-178" and substitute -- 1-1/2 --.

Column 4, line 16: Delete "illustate" and substitute -- illustrate --.

Signed and Sealed this

Tenth Day of March, 1987

*Attest:*

DONALD J. QUIGG

*Attesting Officer*

*Commissioner of Patents and Trademarks*